US008511776B2

(12) United States Patent
Tuttnauer et al.

(10) Patent No.: US 8,511,776 B2
(45) Date of Patent: Aug. 20, 2013

(54) MAINTAINING OPTICAL DENSITY OF IMAGES PRODUCED BY A PRINTING DEVICE

(75) Inventors: Ron Tuttnauer, Netanya (IL); Raz Maoz, Ramat Gan (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 463 days.

(21) Appl. No.: 12/834,563

(22) Filed: Jul. 12, 2010

(65) Prior Publication Data

US 2012/0007905 A1 Jan. 12, 2012

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

| | | | | |
|---|---|---|---|---|
| 5,038,208 | A | 8/1991 | Ichikawa et al. | |
| 6,042,213 | A | 3/2000 | Hayasaki | |
| 6,141,120 | A | 10/2000 | Falk | |
| 6,275,600 | B1 | 8/2001 | Banker et al. | |
| 6,612,676 | B1 | 9/2003 | Minckler | |
| 2003/0053093 | A1 * | 3/2003 | Eom | 358/1.9 |
| 2007/0139456 | A1 * | 6/2007 | Ebihara | 347/15 |

FOREIGN PATENT DOCUMENTS

| | | | |
|---|---|---|---|
| JP | 11275361 | A | 10/1999 |
| JP | 2005305703 | A | 11/2005 |

* cited by examiner

*Primary Examiner* — Laura Martin

(57) ABSTRACT

A method for maintaining the optical density of a printing device includes, with a printhead module of the printing device, printing a color region onto a first test page, the color region including a plurality of sub-regions, each of the sub-regions being printed with a different drive voltage; measuring an optical density of each of the sub-regions printed onto the first test page; determining a response curve based on a relationship between the optical density of the sub-regions and the different drive voltages used to print the sub-regions; and, using the response curve, determining a target drive voltage for the printhead module which will cause the printhead module to print at a target optical density.

19 Claims, 7 Drawing Sheets

MAINTAINING OPTICAL DENSITY OF IMAGES PRODUCED BY A PRINTING DEVICE

BACKGROUND

Various printing devices have been developed for a variety of applications, including both large scale printing on banners and other signage items as well as small scale general consumer printing. These printing devices typically include a number of printheads. Each printhead includes a number of printhead modules. A printhead module includes a set of nozzles configured to eject a marking fluid, such as ink, onto a print medium, such as paper.

The printheads are often secured to a movable platform referred to as a carriage. As the carriage moves in relation to a print medium, a control system individually controls each printhead module to selectively eject marking fluid to create a desired image on the print medium.

A common method of ejecting marking fluid from the printhead modules is to place a piezoelectric or other type of actuator within each nozzle. A piezoelectric actuator is a material that expands when a voltage is applied. This voltage is referred to as the drive voltage. With the proper drive voltage being applied to the actuator, the expansion of the actuator causes the marking fluid within the nozzle to be ejected onto the print medium. In general, a higher drive voltage causes a greater volume of marking fluid to be ejected from the nozzle. In other printing devices, a different type of actuator may be used. For example, in a thermal inkjet printing system, a heating element, such as a resistor, is used to rapidly heat the marking fluid in the nozzle. The thermal energy causes marking fluid to be ejected from the nozzle onto the print medium.

Printing devices that perform a high volume of print jobs experience mechanical degradation of their actuators over time. As a nozzle actuator expands and contracts repeatedly over the life of the printing device, the actuator degrades such that the volume of marking fluid which is ejected from the nozzle changes. This change in volume of marking fluid ejected affects the optical density of the image being printed onto the print medium. Optical density refers to the quantity of marking fluid used, per unit area, to form the desired image.

Furthermore, different printhead modules often degrade at different rates based on different levels of usage and minor variations that may naturally occur during manufacturing. This creates inconsistencies in the optical density of portions of an image being printed by different printhead modules within the printhead system. These inconsistencies in optical density adversely affect the quality of the image being printed.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
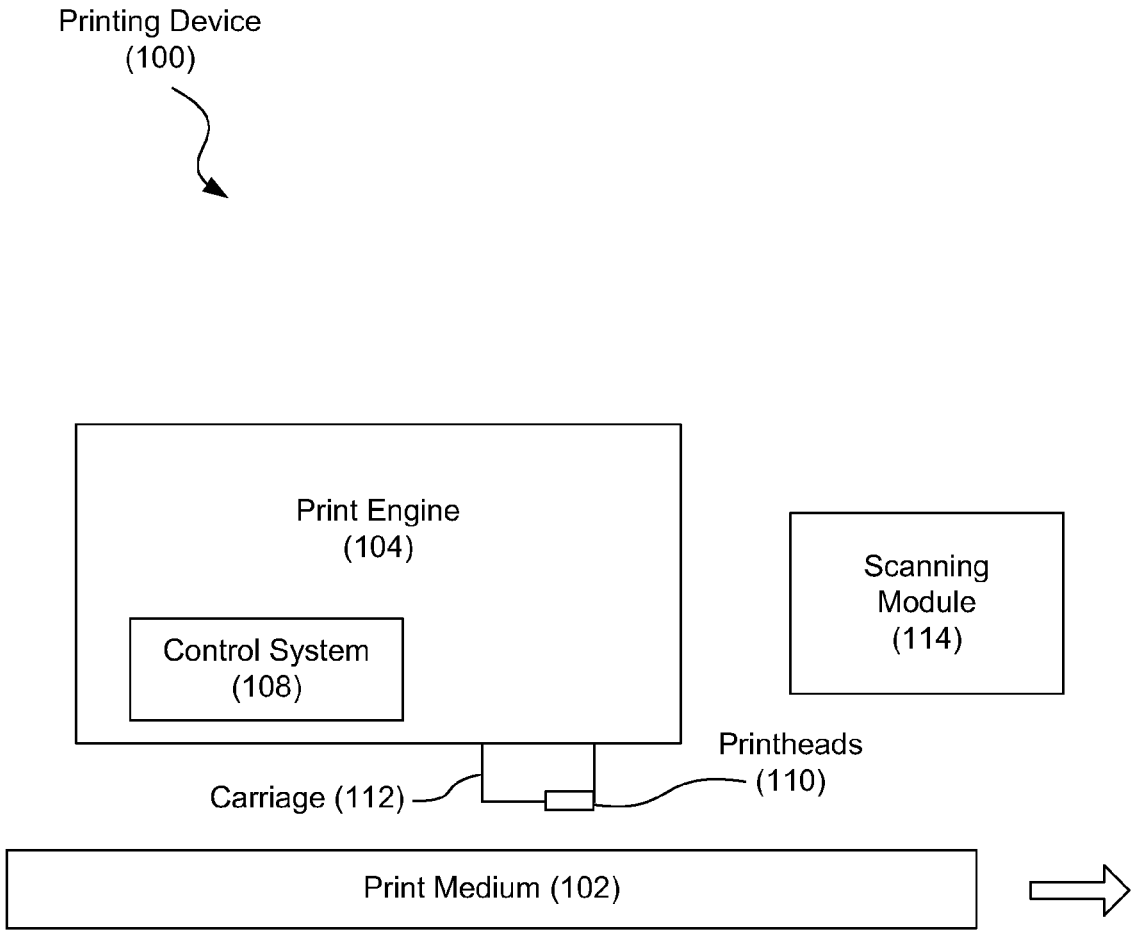
FIG. 1 is a diagram showing an illustrative printing device, according to one example of principles described herein.

As mentioned above, printing devices that perform a high volume of print jobs experience mechanical degradation of their actuators over time. This is due to the consistent and repeated activation of these actuators during normal operation. As a nozzle actuator degrades, the volume of marking fluid which is ejected from the nozzle changes. This change in the volume of marking fluid ejected affects the optical density of the image being printed onto the print medium. Again, optical density is defined as the quantity of marking fluid applied, per unit area, to form the desired image. Furthermore, different printhead modules often degrade at different rates based on varying usage or manufacturing tolerances. This creates inconsistencies in the optical density of an image being printed by the printhead system. These inconsistencies in optical density adversely affect the quality of the image being printed.

In light of this and other issues, the present specification discloses a method for calibrating a printing device so as to maintain optical density of the printed images. This calibration process can be performed during manufacture of the printing device to produce greater consistency among printing devices. The calibration process can also be performed at certain intervals during the life cycle of the printing device to compensate for the actuator degradation.

According to certain illustrative examples, a first test page is printed by the printing device to be calibrated. The first test page includes a number of color regions. Each color region corresponds to one printhead module of the printing device. In some cases, several test pages may be printed in order to print a color region with each printhead module. Each color region is also divided into a plurality of sub-regions. Each sub-region of a particular color region is printed by the same printhead module but with a different drive voltage used to eject the marking fluid from that printhead module.

A scanning module is then used to scan the printed test page or pages. The scanning module measures the optical density of each of the printed sub-regions of each color region. A relationship between drive voltage and optical density for each printhead module can then be constructed. This relationship is then used to create a response curve for each printhead module in the printing device. The response curve is then used to determine the appropriate drive voltage for each printhead module that will cause that printhead module to print at a desired optical density. The desired optical density will be referred to as the target optical density. The drive voltage that produces the target optical density will be referred to as the target drive voltage. Using the response curve for each printhead module, the control system of the printing device is then set to use the target drive voltage for each corresponding printhead module, causing the printhead modules to each print at the target optical density.

To measure the accuracy of this process and make finer adjustments if necessary, a second test page or set of pages may then be printed. The second test pages include a new color region for each printhead module. The new color regions are printed using the target drive voltage for each printhead module as determined from the response curve produced for that printhead module. The second set of test pages can then be compared to a target page that was printed by a separate stable and calibrated printing device. This target page is thus known to have the target optical density printed for each color utilized by the printing device. Comparing the second set of test pages to the target page can be performed either visually by a technician or printing device operator or may be performed electronically using a scanning device. This comparison helps ensure that each printhead module is printing at the target optical density. If any printhead module is not printing at the target optical density, then the target drive voltage of that printhead module can be further tuned to cause that printhead module to print at the target optical density.

Through use of a method or system embodying principles described herein, the optical density of a printing device is rendered more consistent at the time of manufacture and can be more consistently maintained despite the occurrence of actuator degradation and other issues which affect the optical density of a printed image over the life cycle of the printing device. Maintaining the optical density of a printing device allows for a consistent production of quality images.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

As used herein and in the appended claims, the term "actuator" will be used broadly to refer to any device or element that is used to cause the ejection of marking fluid from a printhead.

As used herein and in the appended claims, the term "scanning module" will be used broadly to refer to any device that converts a printed or visible image into digital information. As such, a "scanning module" may be or comprise a stationary sensor or sensor array such as a digital camera or a Charged Coupled Device (CCD). Alternatively, a "scanning module" may be or comprise an optical scanner, such as a rotary scanner, a bed scanner or similar device.

Referring now to the figures, FIG. 1 is a diagram showing an illustrative printing device (100). According to certain illustrative examples, a print engine (104) of the printing device (100) includes a control system (108) and a carriage (110) supporting a number of printheads (110). Each printhead (110) is composed of a number of printhead modules that selectively eject marking fluid from a number of nozzles when the control system (108) applies a drive voltage.

The printing device (100) typically includes a print medium feeding mechanism that moves a print medium (102) past the printheads (110) on the carriage (112) as marking fluid is selectively ejected. Additionally or alternatively, the carriage (112) moves the printheads (110) with respect to the print medium (102) so that marking fluid may be ejected at any point on the print medium.

The printing device (100) also includes a scanning module (114). This scanning module (114) is an optical scanning device capable of measuring the optical density at different portions of a printed image.

The control system (108) includes components of a standard physical computing system such as a processor and a memory. The memory may include a set of instructions that cause the processor to perform certain tasks related to the printing of images. For example, the control system (108) manages the various mechanical components within the print engine (104) and the scanning module (114). Additionally, the control system (108) can convert the image or print job data sent from a client computing system to a format which is used by the printing device (100).

As indicated above, the carriage (112) is designed to support several printheads (110). Each printhead includes several printhead modules. Each printhead module may dispense a different color of marking fluid such that full-color images can be produced by the printing device. As the carriage (112) moves with respect to the print medium (102) and/or the print medium (102) moves underneath the carriage (110), the control system (108) sends a drive voltage signal to the appropriate printhead modules to eject a marking fluid droplet. Marking fluid droplets are ejected in a specific pattern so as to create intended desired image on the print medium (102).

The scanning module (114) is then used to scan the optical density of images printed by the print engine (104). Additionally, images printed by other printing devices may be scanned using the scanning module. As indicated, the scanning module (114) measures the optical density of images it scans.

One way to measure optical density is to convert the scanned image into a grayscale image. A grayscale image includes various shades of gray ranging from white to black. The grayscale level at a particular point on the image is proportional to the optical density of the color at that point on the image. Higher density colors will produce a darker grayscale level and lower density colors will produce a lighter grayscale level.

Figure 2A:
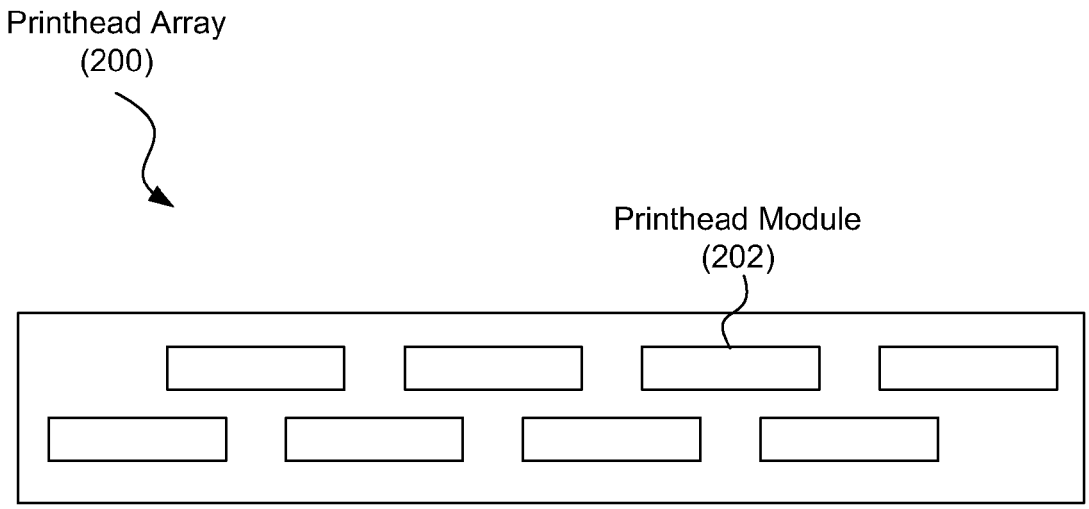
FIG. 2A is a diagram showing an illustrative printhead array, according to one example of principles described herein.

FIG. 2A is a diagram showing an illustrative printhead (200), also referred to as a printhead array. As mentioned above, a printhead (200) typically includes several printhead modules (202). Each printhead module (202) is individually driven by the control system (e.g. 108, FIG. 1), meaning that a different drive voltage may be applied at any time by the control system to a particular printhead module. As indicated above, the drive voltage signal is applied selectively to actuators (214) within the nozzles of each printhead module (202). Having different voltage levels being applied to each printhead module (202) allows the control system to compensate for both degradation of those actuators over time and variations in manufacturing the printhead modules (202). As described above, such degradation and variations in manufacturing cause the various printhead modules (202) to print at slightly different optical densities at the same drive voltage.

Figure 2B:
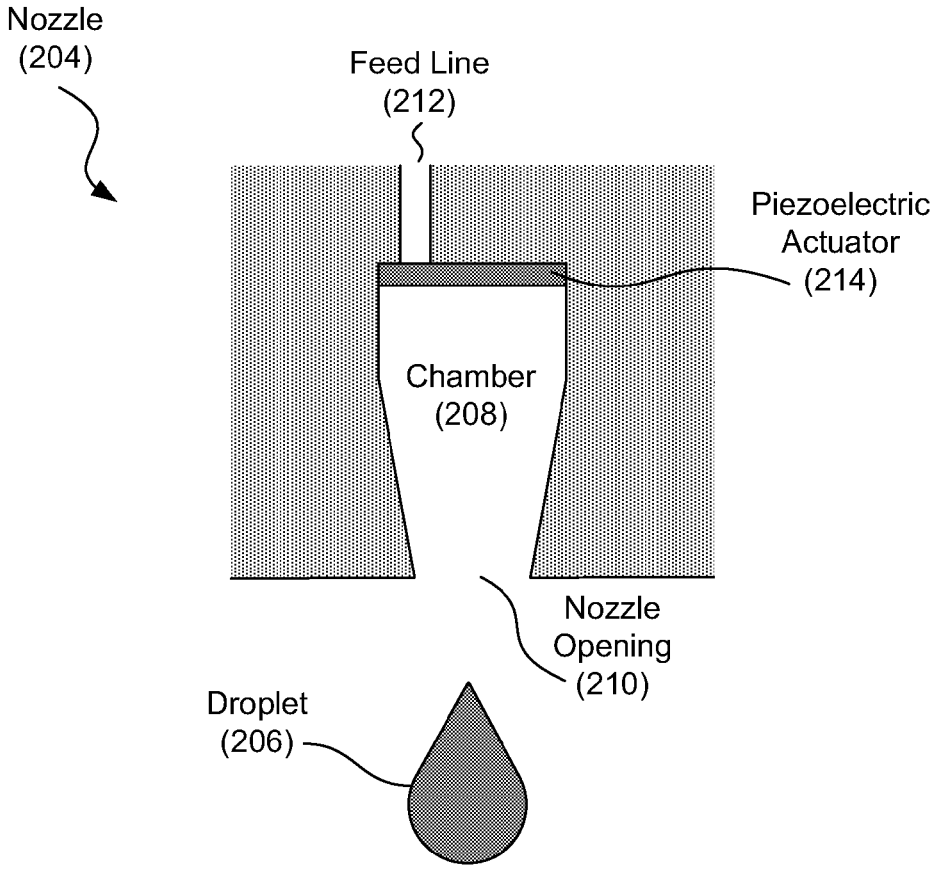
FIG. 2B is a diagram showing an illustrative nozzle, according to one example of principles described herein.

FIG. 2B is a diagram showing an illustrative nozzle (204). According to certain examples, a nozzle includes a small chamber (208) which is filled with marking fluid. An actuator (214) is placed within the small chamber (208). When a voltage is applied to the actuator (214), the actuator (214) expands. This expansion creates a pressure wave within the chamber (208) that forces the marking fluid out of the nozzle opening (210). The ejected marking fluid droplet (206) is then propelled onto a print medium. When the voltage is no longer applied to the actuator (214), the actuator (214) contracts. This contraction creates a void in the chamber. This void will draw in more marking fluid through a feed line (212).

As mentioned above, the repeated activation of the actuator (214) causes degradation over time that affects the amount of marking fluid that is ejected each time the nozzle is fired. The amount of marking fluid ejected per each firing of a nozzle affects the optical density of the image printed with that nozzle. Unaccounted variation in optical density adversely affects the quality of the images printed by the printing device. Consequently, the present specification discloses a calibration process which compensates for actuator degradation and other factors which may cause variation in the optical density printed by different printhead modules.

Figure 3:
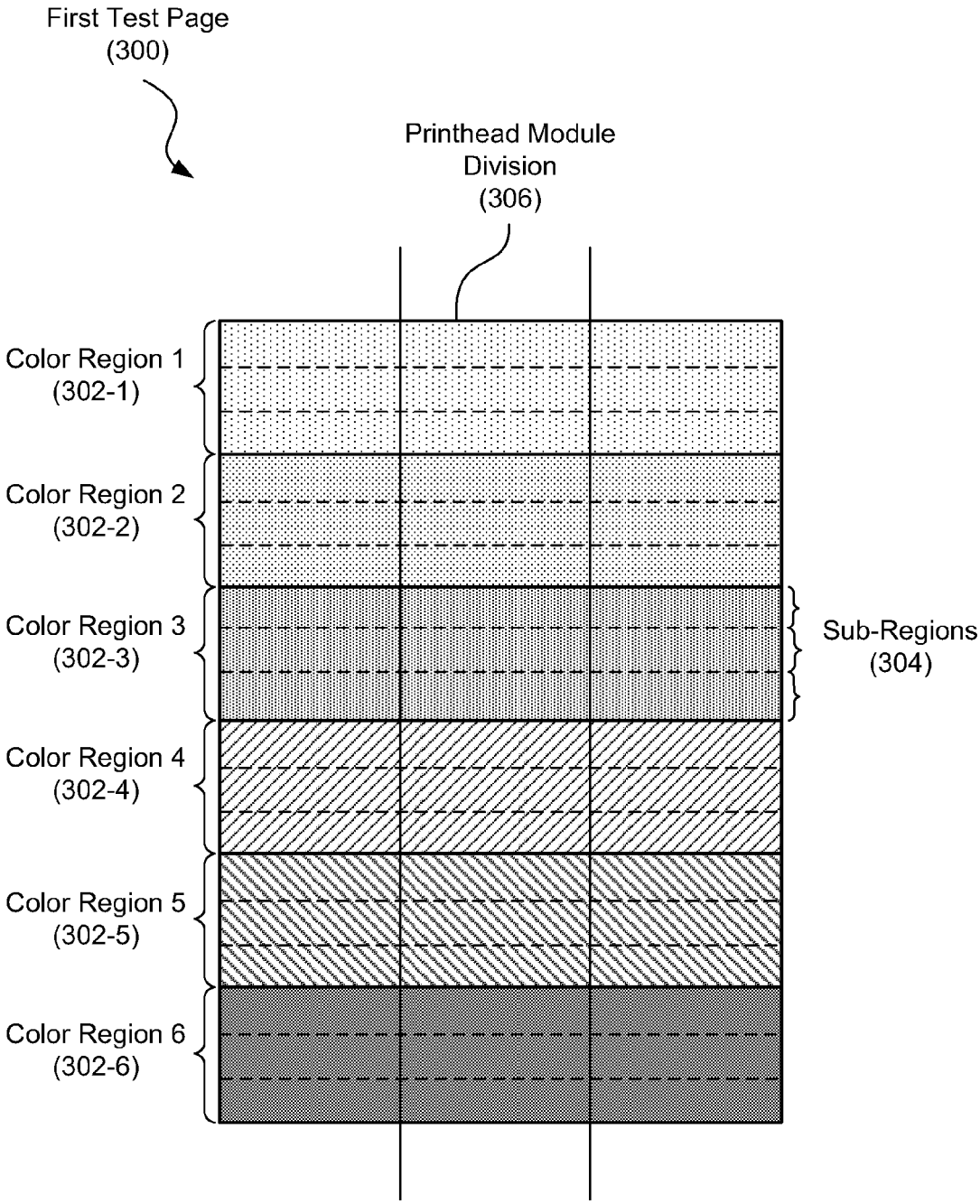
FIG. 3 is a diagram showing an illustrative first test page printed by a printing device being calibrated, according to one example of principles described herein.

FIG. 3 is a diagram showing an illustrative first test (300) page printed by a printing device being calibrated. The test page (300) includes different sections printed by the same printhead module at a range of different drive voltages, for example, at three different drive voltages. By comparing the optical density of portions printed by a particular printhead module at different drive voltages, a response curve representing the actual operation of that printhead module can be determined.

As will be appreciated by those skilled in the art, the first test page (300) may be organized in a wide variety of different ways. FIG. 3 illustrates only one such example. In the illustrated example of FIG. 3, the test page (300) is divided up into six color regions. Color regions (302) are printed for each color of marking fluid utilized by the printing device being calibrated. In FIG. 3, each color region (302) is divided vertically into sub-regions printed with different drive voltages and horizontally into portions printed with different printhead modules.

In the present example, the printing device printing the test page (300) uses six different colors of marking fluid. Thus, color regions (302) for six different colors are printed. For example, color region 1 (302-1) is printed with a light cyan marking fluid, color region 2 (302-2) is printed with a cyan marking fluid, color region 3 (302-3) is printed with a light magenta marking fluid, color region 4 (302-4) is printed with a magenta marking fluid, color region 5 (302-5) is printed with a yellow marking fluid, and color region 6 (302-6) is printed with a black marking fluid.

Each color region for each printhead module division is divided vertically up into a plurality of sub-regions (304). In the example of FIG. 3, each color region is divided vertically into three sub-regions. Different sub-regions (304) are printed using a different drive voltage. This will cause the color at each sub-region (304) of a particular color region (302) to be of a slightly different optical density.

The color regions and sub-regions are further divided horizontally into printhead module divisions (306). Each printhead module division (306) is printed by a different printhead module. The printhead module divisions (306) produce similar color regions and sub-regions. However, due to various differences in the printhead modules, the optical density may be slightly different between adjacent printhead module divisions (306). In some cases, lines may be printed onto the test page (300) to separate the printhead module divisions (306). This can help a scanning module differentiate between the printhead module divisions (306). In some cases, to print a color region for each printhead module will require printing several test pages. Each test page will include color regions (302) printed with different printhead modules.

Once the test page (300) is printed, the optical density of each sub-region and printhead module division is measured with a scanning module (e.g. 114, FIG. 1) as described above. The scanning module will produce data representing the optical density of each sub-region by printhead module division on the test page (300).

With this data a relationship between drive voltage and optical density can be determined for each printhead module. This relationship is then used to create a response curve for each printhead module. The creation and use of the response curve will be described in further detail below in connection with FIG. 4.

Figure 4:
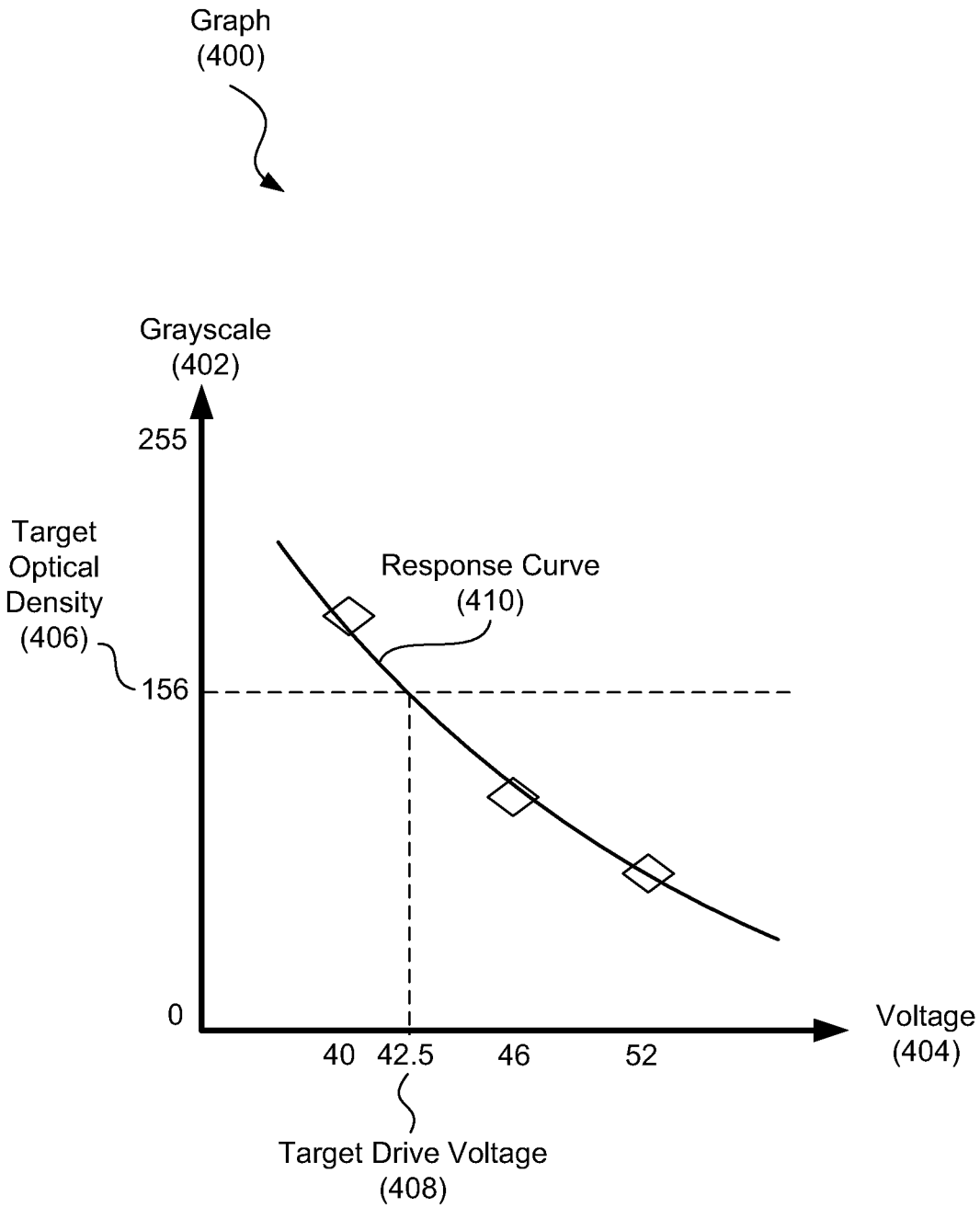
FIG. 4 is a diagram showing an illustrative graph of a response curve based on the measured optical density of regions on the first test page, according to one example of principles described herein.

FIG. 4 is a diagram showing an illustrative graph (400) of a response curve (410) based on the measured optical density of regions on the first test page (e.g. 300, FIG. 3). The response curve (410) illustrated is for a single printhead module. The vertical axis of the graph represents optical density in a grayscale (402) format. A grayscale level of 255 indicates white and a grayscale level of 0 represents black. The horizontal axis represents the drive voltage (404) for the printhead module.

In this example, the sub-regions (e.g. 304, FIG. 3) on the test page were printed at 40 volts, 46 volts, and 52 volts. The test page was then sent through the scanning module. The scanning module determined three different levels of optical density for each sub region. These levels are indicated by the diamond shaped objects in the graph (400). The relationship between drive voltage and measured optical density is not completely linear, nor does the relationship follow a specific curve. The three points illustrated can be used to determine an approximate response curve (410). As will be appreciated by those skilled in the art, a greater number of sub-regions could be printed per color region at a greater range of different drive voltages to provide more points to which a more accurate response curve could be fitted.

The target drive voltage (408) which will cause the printhead module to print at the target optical density (406) can be determined using the response curve (410). For example, an optical density of 156 corresponds to a drive voltage of 42.5 along the response curve (410). In the case that an optical density of 156 is the target optical density, then the drive voltage of 42.5 is the target drive voltage (408) for this particular printhead module represented by the response curve (410). The control system can then be informed that this particular printhead module should be driven at the target voltage (408) of 42.5 volts in order to achieve the target optical density.

This process is performed for each printhead module of the printing device. This allows each printhead module to be driven at a level that will produce a consistent and desired optical density across the printhead array (e.g. 200, FIG. 2). The target optical density (406) to which the printhead modules are calibrated may be a default setting or may be arbitrarily set by a user.

In the case that further tuning is required, the slope of the response curve (410) at various voltage levels is indicative of the change in voltage which will cause a particular change in optical density. The step where tuning may be required will be discussed in more detail below.

Figure 5:
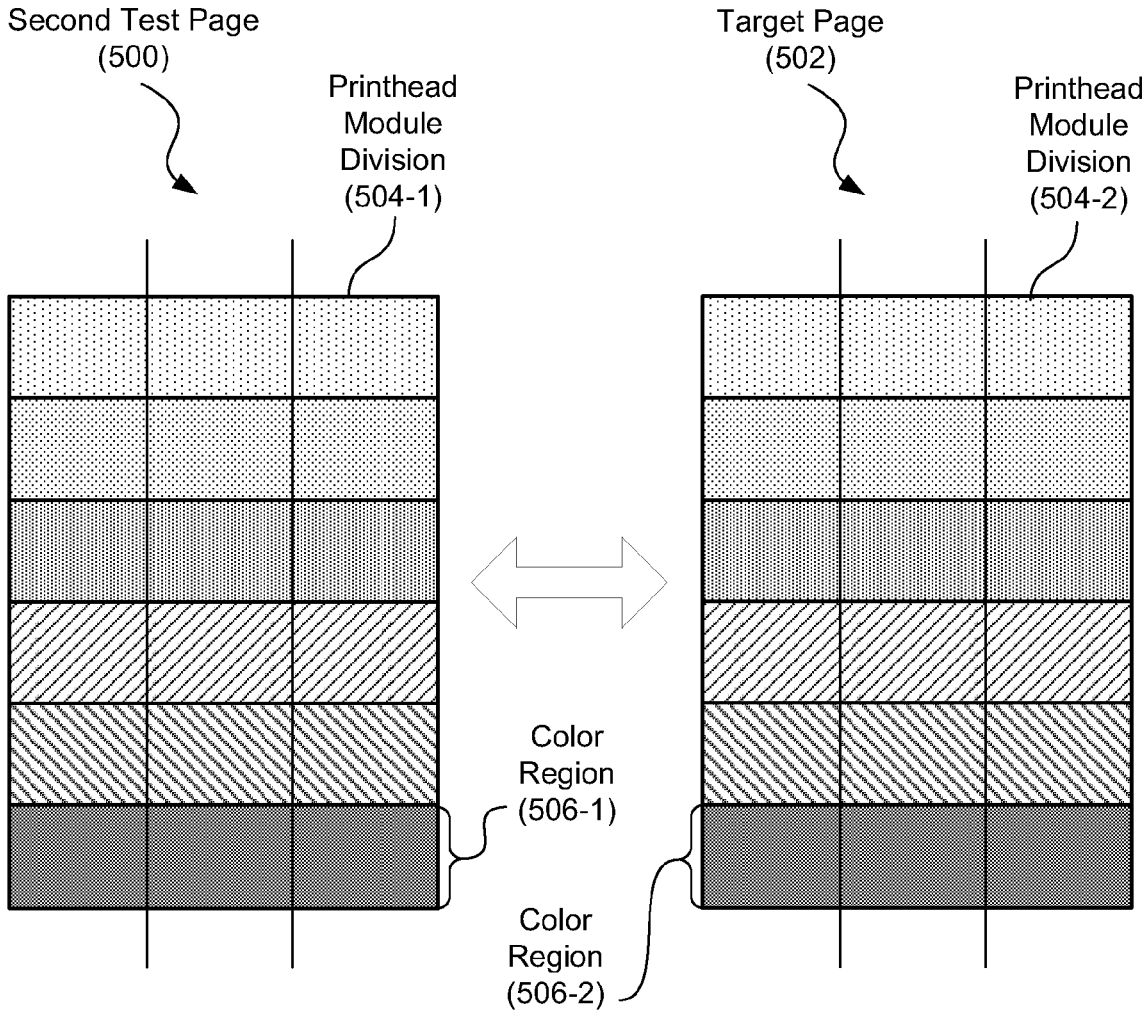
FIG. 5 is a diagram showing an illustrative comparison between a second test page and a target test page, according to one example of principles described herein.

FIG. 5 is a diagram showing an illustrative comparison between a second test page (500) and a target page (502). As mentioned above, after the target voltages have been determined and set for each printhead module, a second test page (500) or set of second test pages is printed using the recalibrated drive voltages. The second test page (500) may have the same generally format as the first test page (e.g. 300, FIG. 3). However, instead of dividing each color region (506) into a number of sub-regions, the second test page (500) is printed at only the target voltage level for each printhead module. The second test page (500) still has the printhead modules division for each printhead module.

To help ensure that the new target voltages for each printhead module are causing the proper optical densities to be printed, the second test page (500) can be compared to a target page (502). As mentioned above, the target page (502) is printed by a different printing device which is known to be properly calibrated. This printing device will be referred to as a trusted printing device. The target page (502) may be in the same format as the second test page (500), but may also be of a different format. The target page (502) will, however, include each color used by the printing device being calibrated.

The optical density of the color regions on the target page (502) can be compared to the optical density of corresponding color regions on the second test page (500) either visually or using an optical scanning module as described herein. If an optical scanning module is used, the target page (502) is measured using the same scanning module used to measure the optical density of the color regions on the second test page (500). If different scanning modules are used, there is a risk that there would be inconsistencies between the optical density measurements produced by variations in the scanning modules rather than actual optical density differences between the pages.

The optical density of each color region (506-1) in each printhead module division (504-1) of the second test page (500) is compared to a corresponding color region (506-2) of a printhead module division (504-2) on the target page (502). If the optical density of a color region (506-1) on the second test page (500) for a particular printhead module is not within a predetermined range of the corresponding color region (506-2) on the target page, then the target voltage for that printhead module is adjusted. The adjustment can be based on the slope of the linearized relationship from the response curve as described above. For example, if the measured optical density is 154 on the grayscale and the target optical density is 156 on the grayscale, then the response curve can be used to determine the change in voltage which will cause the optical density to increase by 2 grayscale points.

An illustrative process for preparing the trusted printing device to produce the target page (502) will now be described. In order to print a target page (502) at the target optical density, a target profile for the trusted printing device is constructed. This target profile allows for the determination of the target voltages which will cause the trusted printing device to print the target page (502) at the desired optical density for each color.

The target profile is created in a manner similar to the manner used to create the response curves for each printhead module. The target profile is created by first printing a calibration page with the trusted printing device. The calibration page includes a number of target color regions, each target color region being divided into target sub-regions. The target sub-regions are printed at different voltage levels. The optical density of each of the target sub-regions on the calibration page is then measured. A relationship between drive voltage and optical density is then used to construct the target profile for each color. The target profile can then be used to determine the proper voltages to be used by the trusted printing device to print the target page (502) at the target optical density for each color.

Figure 6:
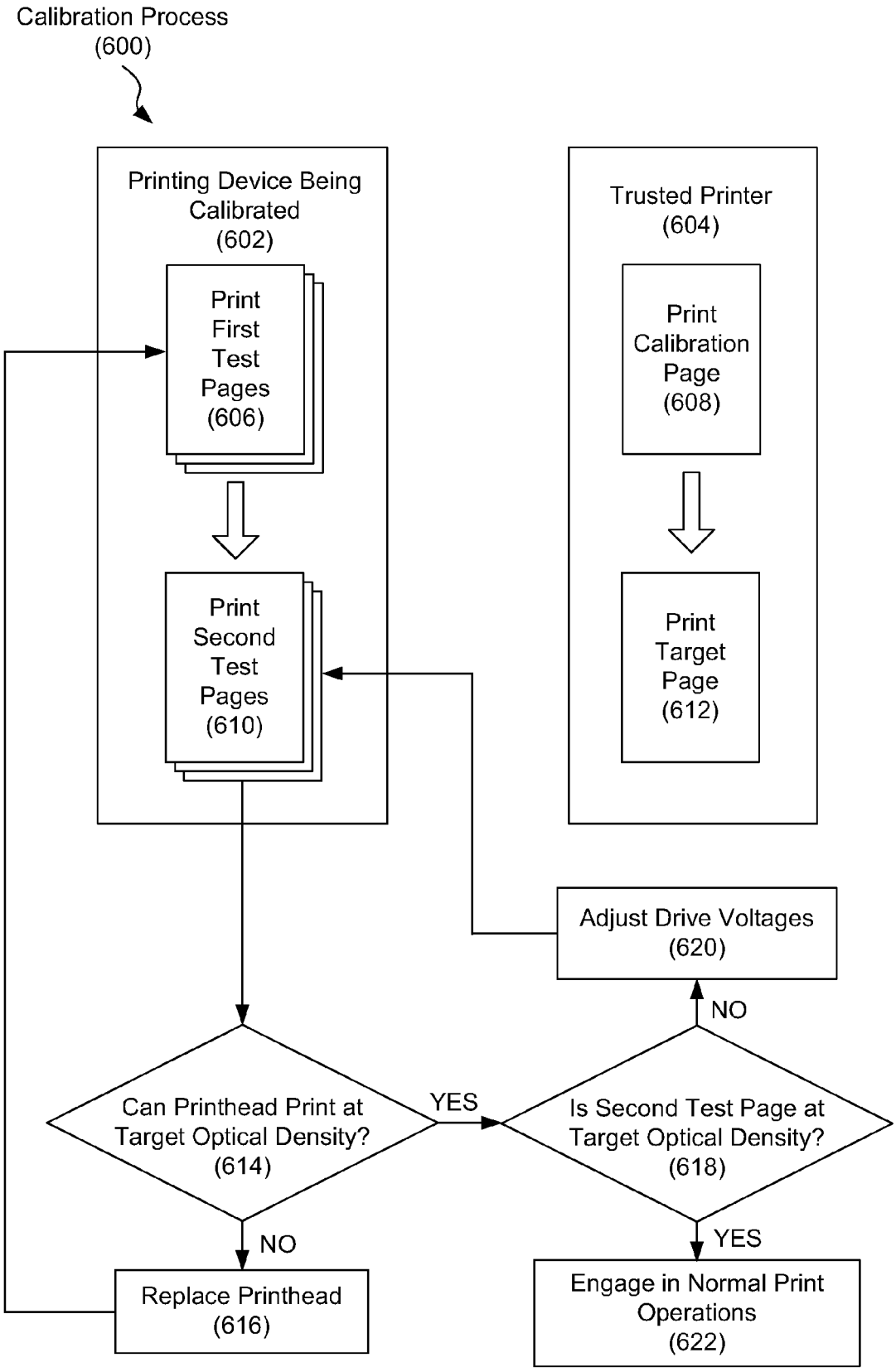
FIG. 6 is a diagram showing an illustrative overview of a calibration process, according to one example of principles described herein.

FIG. 6 is a diagram showing an illustrative overview of a calibration process. As mentioned above, a first test page or set of pages is printed (606) by the printing device being calibrated (602). These first test pages include color regions which are divided up into a plurality of sub-regions and portions printed by different printhead module. Each sub-region is printed at a different voltage level. The test page or pages are then scanned so that the optical density of the sub-regions can be measured. This allows for the creation of a response curve for each print module of the printing device being calibrated (602). The response curve allows the control system of the printing device being calibrated (602) to determine a target voltage for each printhead module. The target voltage for a printhead module is intended to cause that printhead module to print at a target optical density.

In some examples, a second test page or set of test pages is then printed (610) using the target voltage for each printhead module. This second test page can then be compared to a target page.

In such examples, a trusted printing device (604) separately prints (608) a target page. The target page includes a number of target color regions for each color, each target color region being divided into a plurality of target sub-regions. The target page is then scanned so that the optical density of each of the target sub-regions can be measured. From these measurements, a relationship between drive voltage and optical density is used to create a target profile for each color. The target profiles are then used to determine the target drive voltage which will print the target optical density for each color. The target page (612) is then printed using the target voltages derived from the target profiles. These target voltages will then produce the target optical density for each color on the target page (612).

After the second test page or set of pages and the target page have been printed and scanned, the measured optical densities can be compared. This comparison is as described above.

In some cases, the actuators (e.g. 214, FIG. 2) of a printhead module may have degraded so much that no drive voltage will cause the printhead module to print at the target optical density. This is indicated by a shallow slope in the response curve. The control system (e.g. 108, FIG. 1) determines (614) whether each printhead module is able to print at the target density. If any of the printhead modules are not (614, NO) able to print at the target optical density, then those printhead modules are replaced (616) and the calibration process (600) is restarted. If each printhead module is indeed (614, YES) able to print at the target optical density, then the process continues.

The control system then determines (618) whether color regions corresponding to each printhead module match the target density of the target page. If any of the printhead modules do not (618, NO) match the target density, or are not within a predetermined range, then the target voltages of those printhead modules are adjusted (620). Another second test page or set of test pages may then be printed (610) using the adjusted target voltages. This can be repeated as needed. When the optical density of each of the printhead modules does (618, YES) match the optical density of the target page, or fall within the predetermined range, then the printing device being calibrated is ready to engage (622) in normal printhead operations.

Figure 7:
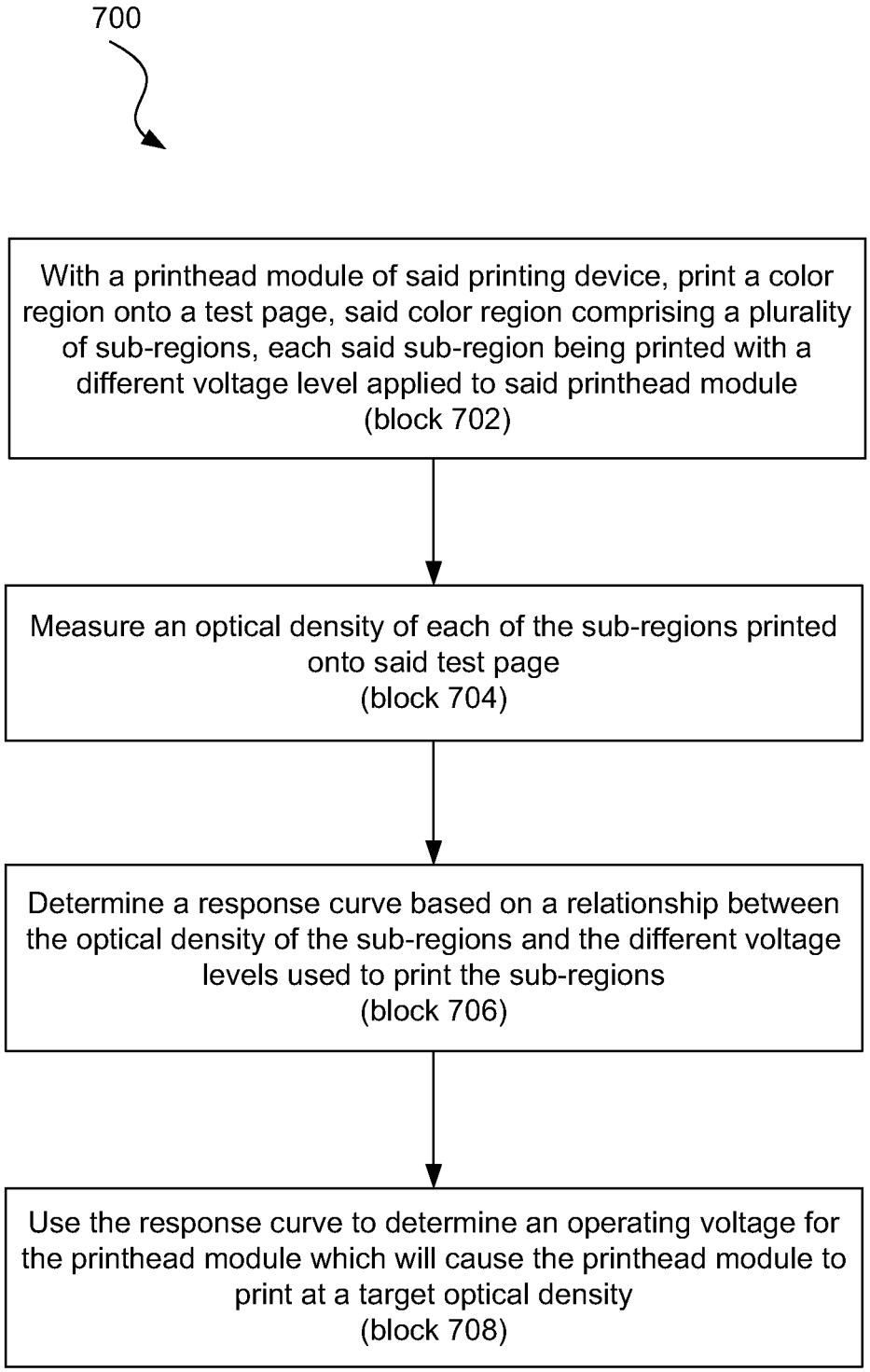
FIG. 7 is a flowchart showing an illustrative method for calibrating a printing device, according to one embodiment of principles described herein.

FIG. 7 is a flowchart showing an illustrative method for calibrating a printing device. According to certain illustrative examples, the method includes with a printhead module of a printing device, printing (block 702) a color region onto a test page, said color region comprising a plurality of sub-regions, each said sub-region being printed with a different voltage level applied to said printhead module; measuring (block 704) an optical density of each of the sub-regions printed onto said test page; determining (block 706) a response curve based on a relationship between the optical density of the sub-regions and the different voltage levels used to print the sub-regions; and using (block 708) the response curve to determine a target voltage for the printhead module which will cause the printhead module to print at a target optical density.

In conclusion, through use of a method or system embodying principles described herein, the optical density of a printing device is maintained despite the occurrence of actuator degradation and other issues which affect the optical density of a printed image. Maintaining the optical density of a printing device allows for a consistent production of quality images.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method for maintaining the optical density of images produced by a printing device, the method comprising:

with a printhead module of said printing device, printing a color region onto a first test page, said color region comprising a plurality of sub-regions, each said sub-region being printed with a different drive voltage;

measuring an optical density of each of said sub-regions printed onto said first test page;

determining a response curve based on a relationship between said optical density of said sub-regions and said different drive voltages used to print said sub-regions;

using said response curve, determining a target drive voltage for said printhead module which will cause said printhead module to print at a target optical density, with said printhead module, printing a new color region on a second test page using said target drive voltage; and comparing an optical density of said new color region to an optical density of a target color region of a target page, said target page being printed by a trusted printing device at said target optical density.

2. The method of claim 1, in which said test page comprises additional color regions, said additional color regions being printed by additional printhead modules of said printing device.

3. The method of claim 2, further comprising, determining a response curve for each of said additional printhead modules.

4. The method of claim 3, further comprising, adjusting a target voltage for each of said additional printhead modules based on a response curve for that printhead module.

5. The method of claim 1, further comprising using said target voltage to drive said printhead module when engaging in subsequent print operations.

6. The method of claim 1, further comprising adjusting said target voltage if said optical density of said new color region is not within a tolerance level of said optical density of said target color region of said target page.

7. The method of claim 1, further comprising, replacing said printhead module if adjusting said target drive voltage cannot produce said target optical density.

8. The method of claim 1, in which said target page is created by:

printing a calibration page with a printhead module of a trusted printing device, said calibration page comprising a target color region comprising a plurality of target sub-regions, each target sub-region being printed with a different voltage level of said printhead module of said trusted printing device;

measuring an optical density of each of said target sub-regions;

creating a target profile based on a relationship between optical density of said target sub-regions and said different voltage levels used to print said target sub-regions;

using said target profile to determine a second target voltage for said printhead module of said trusted printing device which will produce said target optical density; and printing said target page using said second target voltage.

9. A printing device comprising:

a scanning module; and a print engine comprising:

a plurality of printhead modules; and a control system, in which said control system causes one of said printhead modules to print a color region onto a test page, said color region comprising a plurality of sub-regions, each said sub-region being printed with a different drive voltage applied to said printhead module;

causes said scanning module to measure an optical density of each of said sub-regions printed onto said test page;

determines a response curve for each printhead module based on a relationship between said optical density of said sub-regions and said different drive voltages used to print said sub-regions; and uses said response curve to determine a target drive voltage for each said printhead module which will cause that printhead module to print at a target optical density.

10. The printing device of claim 9, in which said control system:

causes each one of said printhead modules to print a new color region on a second test page using said target drive voltage for that printhead module to cause said printhead module to print at said target optical density; and compares an optical density of said new color region to an optical density of a target region of a target page measured by said scanning module, said target page being printed by a trusted printing device at said target optical density.

11. The printing device of claim 10, in which said control system adjusts said target voltage if said optical density of said new color region is not within a predetermined range of said optical density of said target region of said target page.

12. The printing device of claim 10, in which said control system indicates to a user that said one of said printhead modules should be replaced if adjusting said target voltage for said one of said printhead modules cannot produce said target optical density.

13. The printing device of claim 9, in which said control system engages in normal print operations using said target voltage.

14. The printing device of claim 9, in which said scanning module is integrated with said printing device.

15. A method for calibrating a printing device to maintain optical density of colors printed by said printing device, said printing device comprising a plurality of printhead modules, the method comprising:

with each of said printhead modules, printing a color region onto at least one test page, said color region comprising a plurality of sub-regions, each said sub-region being printed with a different drive voltage; measuring an optical density of each of said sub-regions printed onto said at least one test page;

determining a response curve for each of said printhead modules, said response curve based on a relationship between said optical density of said sub-regions and said different drive voltages used to print said sub-regions for that printhead module;

using said response curve to determine a target drive voltage for each of said printhead modules, said target drive voltage causing each printhead module to print at a target optical density, the target optical density being defined by a target page printed by a calibrated printing device at said target optical density.

16. The method of claim 15, further comprising setting said target drive voltage for use with each corresponding printhead module when engaging in normal print operations.

17. The method of claim 15, further comprising:

with each of said printhead modules, printing a new color region on a second test page, each printhead module using its new said target voltage; and comparing an optical density of said new color region to an optical density of a target color region of the target page, said target page being printed by the calibrated printing device.

18. The method of claim 17, further comprising adjusting said target drive voltage of one of said printhead modules if said optical density of said new color region printed by that printhead module is not within a tolerance level of said optical density of said target color region of said target page.

19. The method of claim 17, further comprising, replacing one of said printhead modules if adjusting said target drive voltage of that printhead module cannot produce said target optical density.

* * * * *